US005706902A

United States Patent [19]

Eisenhardt

[11] Patent Number: 5,706,902

[45] Date of Patent: Jan. 13, 1998

[54] POWER HAND TOOL, ESPECIALLY IMPACT SCREWDRIVER

[75] Inventor: Armin Eisenhardt, Hechingen/boll, Germany

[73] Assignee: Atlas Copco Elektrowerzeuge GmbH, Winnenden, Germany

[21] Appl. No.: 615,626

[22] Filed: Mar. 13, 1996

[30] Foreign Application Priority Data

Mar. 23, 1995 [DE] Germany ..... 195 10 578.8

[51] Int. Cl.[6] ..... B25B 19/00

[52] U.S. Cl. ..... 173/93.5; 173/211; 173/216

[58] Field of Search ..... 173/93, 93.5, 93.6, 173/211, 216, 217, 162.1, 210

[56] References Cited

U.S. PATENT DOCUMENTS 2,343,596 3/1944 Van Sittert et al. .
2,662,434 12/1953 Burkhardt .
2,907,239 10/1959 Schwenk .

FOREIGN PATENT DOCUMENTS 1 163 259 9/1964 Germany .
39 37 816 A1 6/1990 Germany .
91 11 449.7 2/1992 Germany .

*Primary Examiner*—Scott A. Smith
*Attorney, Agent, or Firm*—McGlew and Tuttle

[57] ABSTRACT

In a power hand tool, especially a screwdriver, with a motor, a planet gear and a rotary impulse generator, a spring mechanism is provided to damp vibrations of the housing caused by the rotary impulse generator. To improve the damping with a simple design, one end of a compression spring is supported on a ring, which in turn is guided at a coil which is parallel to the axis, on the one hand, and is guided displaceably in parallel to the axis between a part rigidly connected to the housing and a part exposed to the rotary impact, on the other hand. The other end of the compression spring is supported on a part rigidly connected to the housing.

15 Claims, 4 Drawing Sheets

POWER HAND TOOL, ESPECIALLY IMPACT SCREWDRIVER

FIELD OF THE INVENTION

The present invention pertains to a power hand tool, especially an impact screwdriver, with a motor, a reducing gear, and a rotary impulse generator in a housing, wherein a spring means is provided for damping vibrations of the housing generated by the rotary impulse generator.

BACKGROUND OF THE INVENTION

Such a power hand tool is described in DE 39 37 816 A1. The motor acts via the reducing gear on the rotary impulse generator, which transmits impact-like rotary impulses on the screwdriver to increase the tightening torque. These rotary impacts lead to unpleasant vibrations of the housing. To damp these vibrations, a torsion spring is provided according to DE 39 37 816 A1.

The introduction of the force into the torsion spring leads to design problems. In addition, it is difficult to reach a greater torsion angle of the torsion spring, and vibration problems occur. Moreover, the torsion spring acts only during the tightening of the screw connection (rotation to the right), but not during the loosening of the screw connection (rotation to the left). It is destroyed during rotation to the left.

SUMMARY AND OBJECTS OF THE INVENTION

The object of the present invention is to suggest a power hand tool of the type described in the introduction, in which the damping is improved with a simple design.

This object is accomplished according to the present invention in a power hand tool of the above-described type by one end of the spring being supported on a ring, which is guided at a coil that is parallel to the axis of rotation, on the one hand, and is displaceable in parallel to the axis, on the other hand, and by the other end of the spring being supported at a part that is rigidly connected to the housing, so that the spring is axially tensioned during a rotary impact.

The ring is displaced in parallel to the axis during a rotary impact as a consequence of it being mounted on the coil. The spring is axially tensioned as a result. The spring relaxes after the rotary impact. It is achieved as a result that no torsion spring is necessary. A coiled compression spring is preferably used. It would also be possible to use a tension spring.

The device described effectively dampens the vibrations and reduces the generation of noise. It is possible to obtain a great angle of rotation for a desired damping by correspondingly dimensioning the pitch of the coil. It is also favorable that a small space is sufficient in the housing for the installation of the device.

The ring is preferably guided with its inner circumference at the coil, which is arranged on the outside at a part exposed to the rotary impact. The ring is thus guided axially displaceably and nonrotatably at its outer circumference by a guide that is rigidly connected to the housing. However, the reversed arrangement, in which the coil is rigidly connected to the housing and the ring is guided axially displaceably and nonrotatably at a part exposed to the rotary impact, would also be possible.

In the preferred embodiment of the present invention, the ring is mounted on the coil by means of balls. Correspondingly weaker frictional forces occur between the ring and the coil in this case. If higher frictional forces are desirable for supporting the damping and/or a further simplification of the design is desirable, the ring may engage the coil with one or more projecting parts made in one piece with it.

The said spring is tensioned during rotation to the right, i.e., during the tightening of the screw connection. An additional damping element is associated with the ring on its front side located opposite the spring in the embodiment of the present invention for damping impacts during rotation to the left (loosening of the screw connection). This damping element may be a simple elastomer body or, to improve damping during rotation to the left, an additional coiled compression spring.

The ring is preferably guided displaceably in parallel to an axis between the part which is rigidly connected to the housing and the part exposed to the rotary impact. The ring may be guided with its inner circumference at the coil, which is arranged on an outside of the part exposed to the rotary impact. The ring is guided axially displaceably and nonrotatably with its outer circumference at the guide which is rigidly connected to the housing. The coil may be provided on the outside of the ring wheel of the reducing gear formed by the planetary gear. The coil may also be provided on the outside of the jacket of the rotary impulse generator.

The ring may be mounted on the coil by means of a ball. Plural balls are preferably provided held at spaced locations from one another on the circumference of the ring. The coil preferably has multiple turns corresponding to the number of these balls. In the relaxed stated, the spring preferably has a pretension which holds the part exposed to the rotary impact relatively blocked against the part at which the ring is guided displaceably in parallel to the axis as long as no special rotary impact moment occurs. The spring is preferably tensioned during rotation to the right and an additional damping element is associated with the ring on its front side located opposite the spring to dampen rotary impacts during rotation to the left. The additional damping element may be a spring-elastic body, especially and elastomer body. The additional damping element may also be an additional coiled compression spring.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
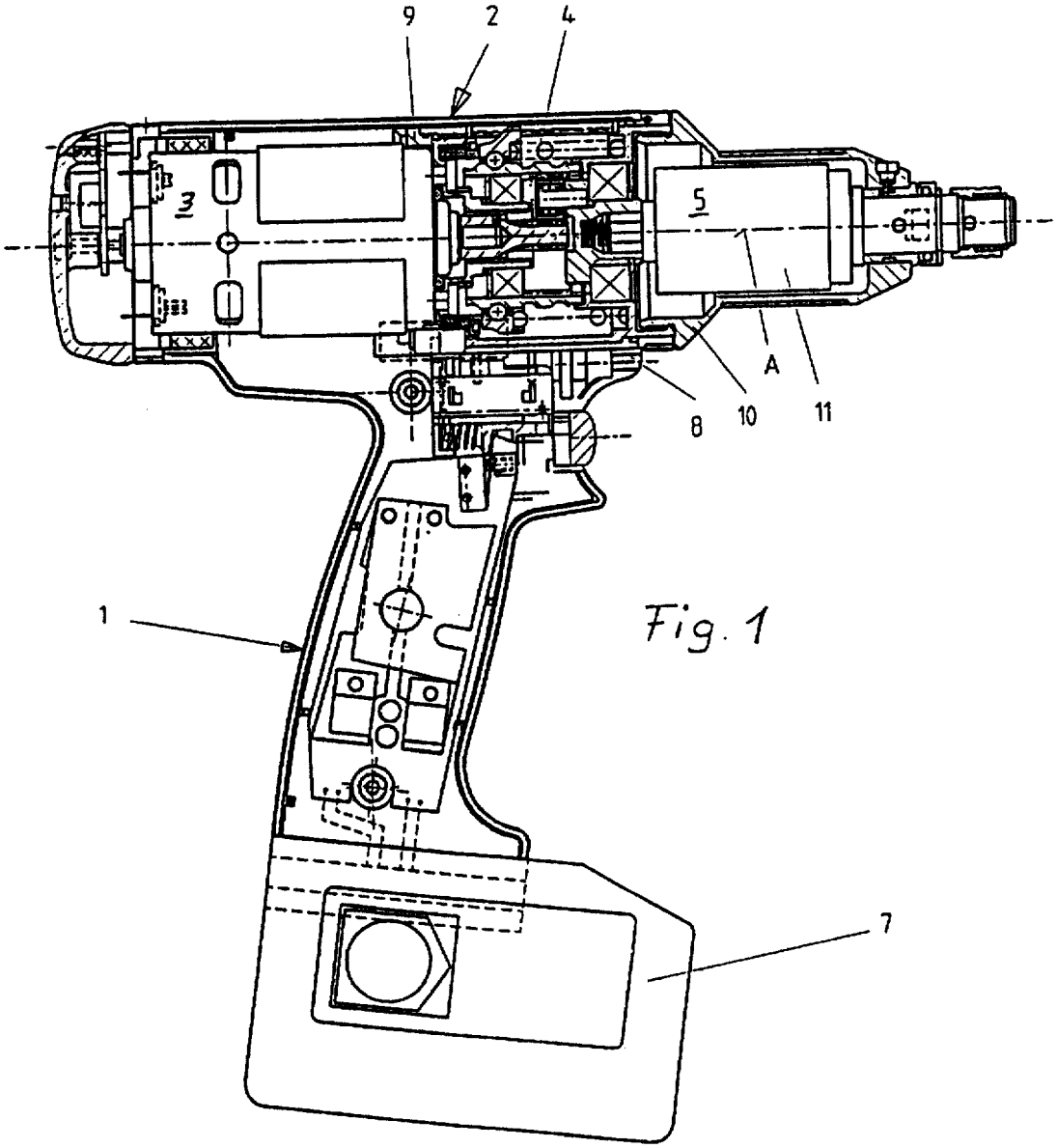
FIG. 1 is a sectional view of a battery-operated impact screwdriver.

An impact screwdriver has a handle housing part 1 and a drive housing part 2, in which a motor 3, a planet gear 4, and a rotary impulse generator 5 are arranged. Via the planet gear 4, acting as a reducing gear, the motor 3 drives the rotary impulse generator 5, which in turn drives a shaft 6, to which a screwdriver, not specifically shown, can be attached. The common axis of the drive unit is designated with A.

The motor 3, which is an electric motor, can be operated from a battery pack 7. It could also be a line-powered electric motor or a compressed air motor. The rotary impulse generator 5 is a prior-art, commercially available unit.

The planet gear 4 has a gear housing 8, which is fastened in the drive housing part 2. On the one hand, a support 9, on which the motor 3 is held, is screwed to the gear housing 8. On the other hand, a cover 10, in which the rotary impulse generator 5 is mounted in the exemplary embodiment according to FIGS. 1 through 4, is screwed to the gear housing 8.

Figure 2:
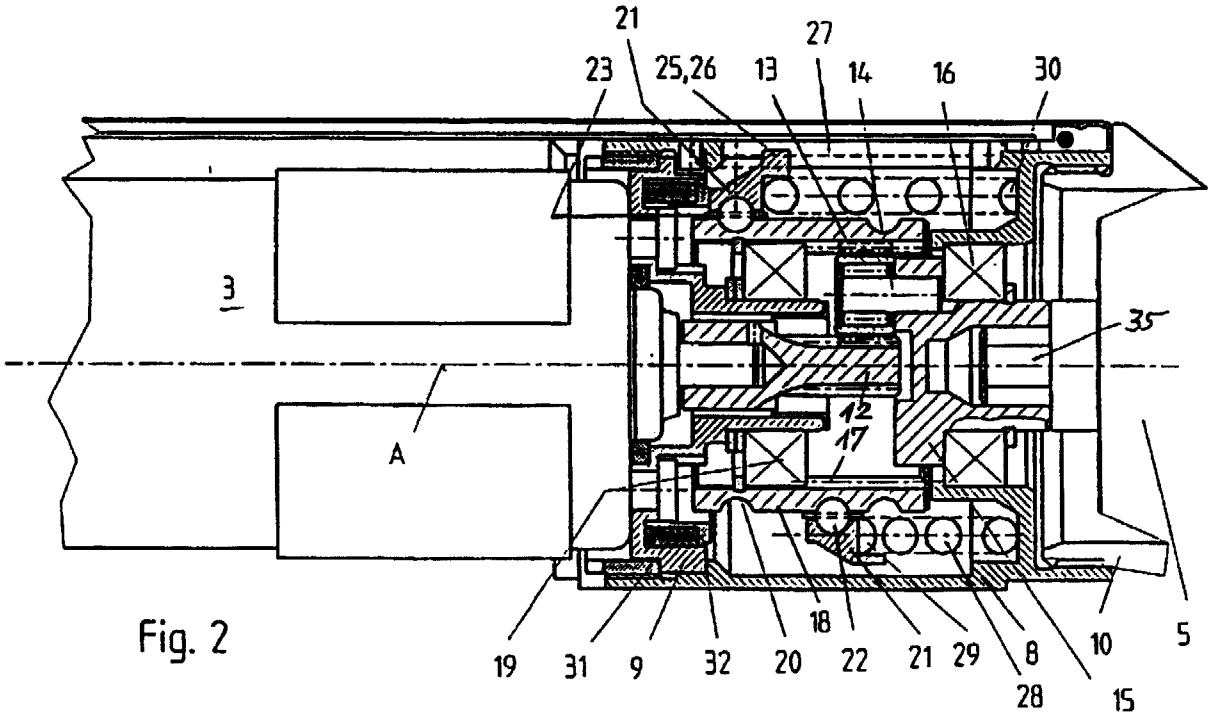
FIG. 2 is a partial sectional view enlarged compared with FIG. 1.
Figure 3:
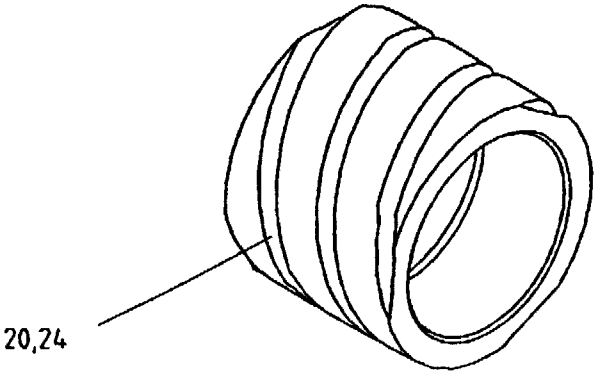
FIG. 3 is a partial perspective view of a coil at a ring gear of the gear mechanism.
Figure 4:
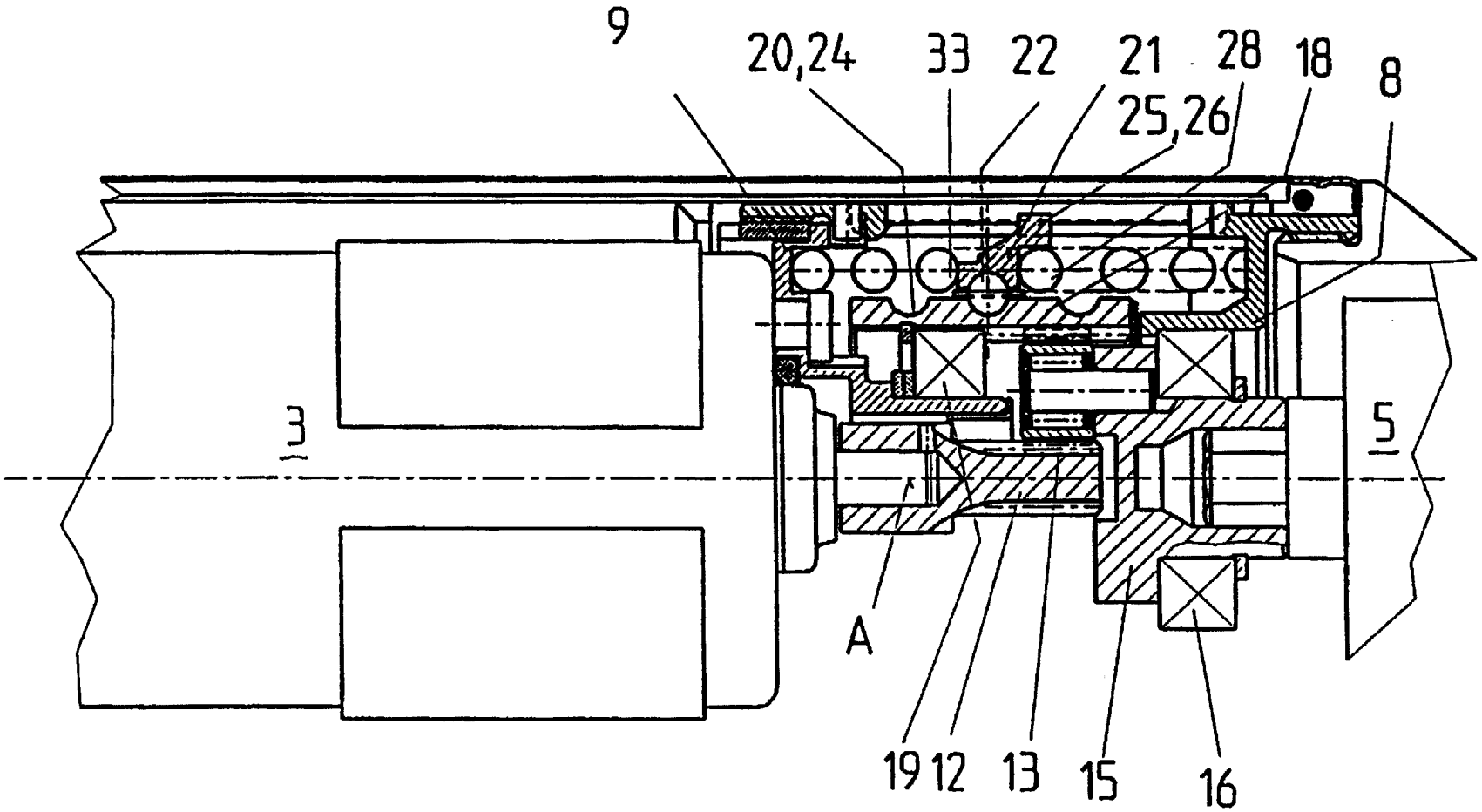
FIG. 4 is a sectional view of another exemplary embodiment essentially corresponding to the view in FIG. 2.

A pinion 12 of the motor 3 meshes with planet wheels 13 of the planet gear 4, one of which is shown in FIGS. 2 and 4. The planet wheel 13 is mounted on an axle stub 14, which is seated in a planet web 15 for driving the rotary impulse generator 5. The planet web 15 is mounted on the gear housing 8 by means of a ball bearing 16.

The planet gear 4 has a ring gear 18 provided with internal teeth 17. The planet wheels 13 mesh with the internal teeth 17. An additional ball bearing 19 is arranged between the ring gear 18 and the support 9.

In the embodiment according to FIGS. 2 and 4, the ring gear 18 is provided on the outside with a coil 20, which extends in parallel to the axis of rotation (A) and is formed by a groove-shaped depression. A ring 21 is associated with the coil 20. The said ring is in connection with the coil 20 by means of one or more balls 22. One ball is shown in FIGS. 2 and 4 each. Three or more balls are preferably provided, distributed on the inner circumference of the ring 21. If, e.g., three balls 22 are provided, the coil 20 is provided with three parallel turns. If, e.g., a plurality of balls 22 are provided, the coil 20 is provided with a plurality of parallel turns. The balls 22 are arranged in a cage 23 to maintain their distributed locations provided on the outer circumference of the ring gear 18 and on the inner circumference of the ring 21. It would also be possible to provide a coil 20 having only one turn. The ball-accommodating groove 24 of the ring 21 would have to have the same pitch as the coil 20 in that case.

The ring 21 is guided nonrotatably but axially displaceably with its outer circumference 25, e.g., by means of a lug 26, at a longitudinal guide slot 27 of the gear housing 8, which slot is parallel to the axis A. One end 29 of a compression spring 28 is supported by the ring 21. The other end 30 of the compression spring 28 is supported on the gear housing 8.

The mode of operation of the device described is essentially as follows:

During phases of operation during which the rotary impact does not react to the ring gear 18 via the planet web 15 and the planet wheels 13, the ring gear 18 is relatively blocked, because the ring 21, which is in connection with the coil 20 via the balls 22, is pretensioned by the compression spring 28. This position of the ring 21 and of the compression spring 28 is shown above the axis A in FIG. 2.

If a correspondingly higher recoil torque acts on the ring gear 18 as a consequence of a more powerful rotary impact, the said ring gear will rotate around the axis A and carries with it the ring 21 via the balls 22, and the ring will tension the compression spring 28. The resulting angle of rotation of the ring gear 18 depends on the pitch of the coil 20 and the spring characteristic of the compression spring 28. It is achieved as a result that pressure impact-generated vibrations are damped in relation to the drive housing part 2 and consequently also in relation to the handle housing part 1, so that no troublesome vibrations or noise is generated. Since the coil 20 extends over substantially more than 360°, good damping values can be obtained if the spring characteristic of the compression spring 28 is taken into account. A position in which the ring 21 has been displaced in parallel to the axis as a consequence of a rotation of the ring gear 18 and the compression spring 28 has been tensioned even more is shown under the axis A in FIG. 2.

The compression spring 28 relaxes after a rotary impact peak and turns back the ring gear 18 via the ring 21 and the balls 22, and the energy stored in the compression spring 28 reacts via the planet gear 4 and the rotary impulse generator 5 to the screwdriver, supporting its torque.

The function explained above on the basis of FIG. 2 applies to the case of the tightening of a screw (rotation to the right). Powerful rotary impact peaks, which may lead to vibrations, may also occur when a screw is being loosened. To damp these vibrations, a spring-elastic or rubber-elastic body, e.g., an elastomer ring 31, which is covered by a bushing 32 facing the ring 21, is arranged in the support 9 in the embodiment according to FIG. 2. During a rotary impact during rotation to the left, the ring 21 strikes the bushing 32 and consequently the elastomer ring 31 as well, so that damping takes place during rotation to the left as well.

Instead of the elastomer ring 31, an additional compression spring 33 is arranged between the support 9 and the ring 21 in the exemplary embodiment according to FIG. 4. The spring 33 acts during rotation to the left in exactly the same way as does the spring 28 during rotation to the right. The ring gear 18 rotates during a rotary impact peak during rotation to the left and it carries with it the ring 21 via the balls 22, while tensioning the additional compression spring 33.

Figure 5:
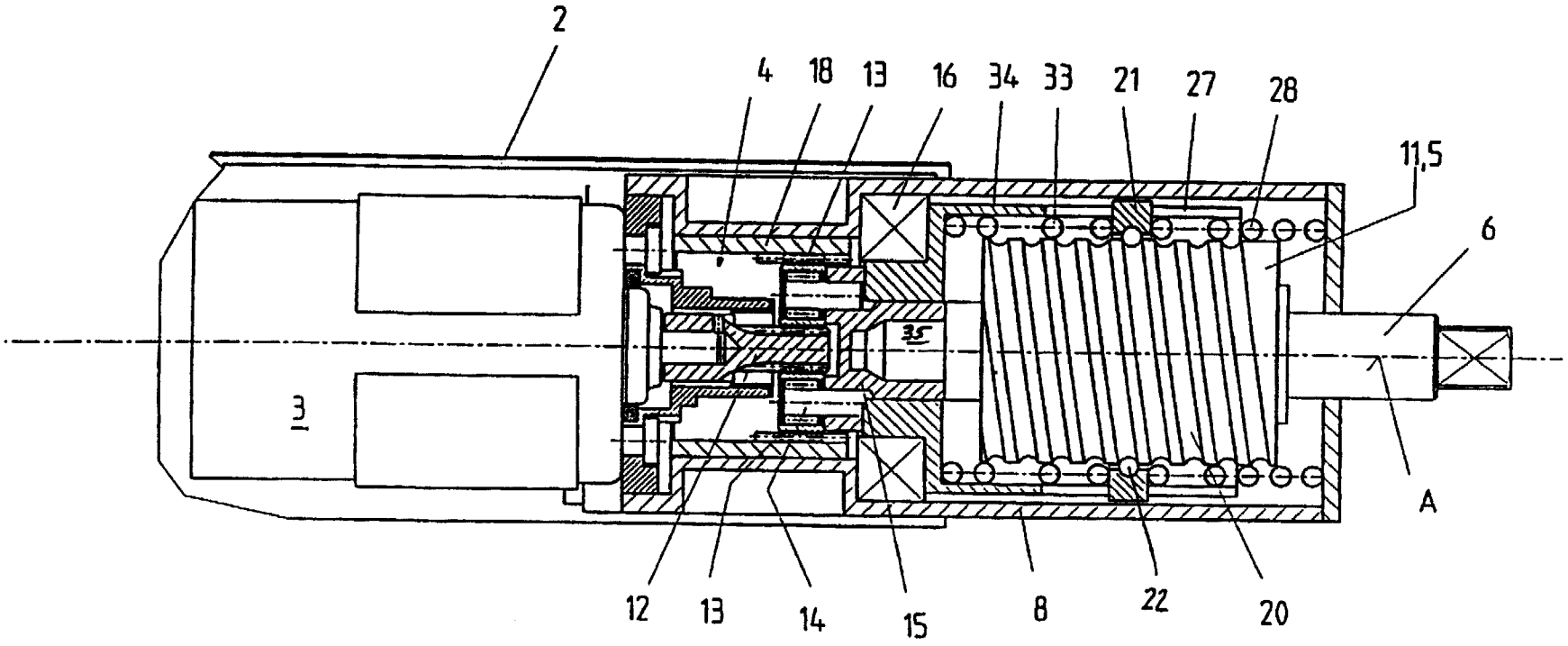
FIG. 5 is a sectional view of another exemplary embodiment.

In the exemplary embodiment according to FIG. 5, the coil 20 is provided on the jacket 11 of the rotary impulse generator 5 rather than on the ring gear 18. The impulse generator 5 is arranged nonrotatably in the housing 8. The parts which are the same as in FIGS. 2 and 4 are designated with the same reference numbers in FIG. 5. The above-described rotary impacts also act on the jacket 11 of the rotary impulse generator 5. In the embodiment according to FIG. 5, their effect on the housing is damped by the ring 21, which engages the coil 20 via balls 22 and is guided displaceably in parallel to the axis A in longitudinal guide slots 27 of an inner part 34. The ring 21 is supported on both sides by compression springs 28, 33, as in FIG. 4.

The inner part 34 is nonrotatably mounted on the planet web 15. The planet web 15 and the inner part 34 may be made in one piece. The ring 21 transmits the rotary movement of the planet web 15 to the jacket 11 of the rotary impulse generator 5, whose shaft 35 is mounted rotatably in the planet web 15 in FIG. 5. If it is disturbing that the spring 28 is supported on the rotating ring 21, on the one hand, and on the non-rotating housing 8, on the other hand, it is possible to provide a bearing, which guarantees that the spring 28 is mounted rotatably or nonrotatably at both ends.

While specific embodiments of the invention have been shown and described in detail to illustrate the application of the principles of the invention, it will be understood that the invention may be embodied otherwise without departing from such principles.

What is claimed is:

1. A power hand tool, comprising:

a housing;

a motor disposed in said housing;

a reducing gear disposed in said housing;

a rotary impulse generator disposed in said housing;

spring damping means for damping vibrations of said housing caused by said rotary impulse generator including coil guide means which is parallel to an axis of rotation, a ring guided at said coil guide means, said coil guide means for displaceably guiding said ring in parallel to said axis of rotation, a spring and a part rigidly connected to said housing, said spring having one end supported on said ring and having another end supported on said part rigidly connected to said housing whereby said ring is axially tensioned during a rotary impact.

2. A power hand tool according to claim 1, wherein said spring is one of a coil compression spring and a tension spring.

3. A power hand tool according to claim 1, wherein said ring is guided displaceably in parallel to said axis of rotation between said part which is rigidly connected to said housing and a part exposed to rotary impact.

4. A power hand tool according to claim 3, wherein said spring, in a relaxed-most state, has a pretension which holds said part exposed to rotary impact substantially blocked against a part at which said ring is guided.

5. A power hand tool according to claim 1, wherein said ring has an inner circumference guided at said coil, said coil being defined on an outside of said part exposed to rotary impact.

6. A power hand tool according to claim 5, wherein said rotary impulse generator includes an outer jacket, said coil being provided on an outside of said outer jacket of said rotary impulse generator.

7. A power hand tool according to claim 1, further comprising a guide rigidly connected to said housing, said ring being guided axially displaceably and non-rotatably with its outer circumference connected to said guide.

8. A power hand tool according to claim 7, wherein said reducing gear is formed by a planet gear including a ring wheel, said coil being provided on an outside of said ring wheel.

9. A power hand tool according to claim 1, wherein said spring damping means includes a ball for mounting said ring on said coil guide means.

10. A power hand tool according to claim 9, further comprising additional balls cooperating with said ball, said balls and said ball being held at spaced locations from one another along a circumference of said ring.

11. A power hand tool according to claim 10, wherein said coil comprises a plurality of turns corresponding to a number of said balls.

12. A power hand tool according to claim 1, wherein said spring is tensioned during rotation in a first direction and an additional damping element is provided associated with said ring on a front side located opposite said spring to damp rotary impacts during rotation in an opposite direction.

13. A power hand tool according to claim 12, wherein said additional damping element is a spring elastic body.

14. A power hand tool according to claim 13, wherein said spring elastic body is an elastomer body.

15. A power hand tool according to claim 12, wherein said additional damping element is an additional coiled compression spring.

* * * * *